US005779602A

United States Patent [19]

Rodriguez

[11] Patent Number: 5,779,602

[45] Date of Patent: Jul. 14, 1998

[54] SYSTEM FOR RAISING WEIGHTS WHEN ACTIVATED BY A USER IN RESPONSE TO A DANGEROUS SITUATION

[76] Inventor: Anibal Rodriguez, 11 Edwards St., Apt. #1, Springfield, Mass. 01105

[21] Appl. No.: 712,461

[22] Filed: Sep. 11, 1996

[51] Int. Cl.[6] ..... A63B 21/078

[52] U.S. Cl. ..... 482/104

[58] Field of Search ..... 482/104, 106, 482/94, 908

[56] References Cited

U.S. PATENT DOCUMENTS

| | | | |
|---|---|---|---|
| 4,799,672 | 1/1989 | Barrett | 482/104 |
| 5,281,193 | 1/1994 | Colbo, Jr. | 482/104 |

FOREIGN PATENT DOCUMENTS

| | | | |
|---|---|---|---|
| 1443892 | 12/1988 | U.S.S.R. | 482/104 |

*Primary Examiner*—Lynne A. Reichard
*Assistant Examiner*—John Mulcahy

[57] ABSTRACT

A system for raising weights when activated by a user in response to a dangerous situation comprising a housing; a bracket with at least one essentially U-shaped receiver for supporting a horizonal bar of free weights; a spring mechanism situated within the housing for forcing the U-shaped receiver to an upper extended orientation in an unbiased orientation and allowing the receiver to reside in a lower retracted orientation in a biased orientation; containment mechanism situated within the housing for selectively maintaining the spring mechanism in a biased orientation in a first mode of operation and further allow the spring mechanism to force the U-shaped receiver to an upper extended orientation in a second mode of operation; and releasing mechanism coupled to the containment mechanism for selectively converting the containment mechanism from a first mode of operation to a second mode of operation upon the actuation thereof thus allowing the at least one receiver to uphold the bar with weights situated thereon.

5 Claims, 4 Drawing Sheets

SYSTEM FOR RAISING WEIGHTS WHEN ACTIVATED BY A USER IN RESPONSE TO A DANGEROUS SITUATION

BACKGROUND OF THE INVENTION

1. Field of the Invention

The present invention relates to a system for raising weights when activated by a user in response to a dangerous situation and more particularly pertains to lifting weights from a user when the user generates a signal at any one of a plurality of locations.

2. Description of the Prior Art

The use of devices of a wide variety of designs and configurations for abating injury while lifting weights is known in the prior art. More specifically, devices of a wide variety of designs and configurations for abating injury while lifting weights heretofore devised and utilized for the purpose of increasing the safety attendant with the lifting of weights through a wide variety of methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art in U.S. Pat. No. 4,262,901 discloses a safety device for use in bar bell exercises and the like.

U.S. Pat. No. 4,411,425 a type of bench press safety rest.

U.S. Pat. No. 4,527,797 discloses a system for weight lifting exercising.

U.S. Pat. No. 4,875,676 discloses a weight lifting machine for safe free-bar bench press exercising.

U.S. Pat. No. 5,273,506 discloses a self spotting exercise apparatus.

In this respect, the system for raising weights when activated by a user in response to a dangerous situation according to the present invention substantially departs from the conventional concepts and designs of the prior art, and in doing so provides an apparatus primarily developed for the purpose of lifting weights from a user when the user generates a signal at any one of a plurality of locations.

Therefore, it can be appreciated that there exists a continuing need for a new and improved system for raising weights when activated by a user in response to a dangerous situation which can be used for lifting weights from a user when the user generates a signal at any one of a plurality of locations. In this regard, the present invention substantially fulfills this need.

SUMMARY OF THE INVENTION

In view of the foregoing disadvantages inherent in the known types of devices of a wide variety of designs and configurations for abating injury while lifting weights now present in the prior art, the present invention provides an improved system for raising weights when activated by a user in response to a dangerous situation. As such, the general purpose of the present invention, which will be described subsequently in greater detail, is to provide a new and improved system for raising weights when activated by a user in response to a dangerous situation and method which has all the advantages of the prior art and none of the disadvantages.

To attain this, the present invention essentially comprises a new and improved system for raising weights when activated by a user in response to a dangerous situation comprising, in combination, a housing in a generally rectangular configuration having parallel interior and exterior walls and parallel rectangular end walls, the walls coupled at their vertical edges to form a box-like configuration with a planar roof secured to the upper edges of the walls, the roof having two parallel slots therethrough, the housing also having a base plate with an upper surface and a lower surface, the upper surface receiving the lower edges of the wall with adjustable legs extending from the two sides and front of the base plate in a downward direction for leveling purposes, an intermediate support plate located within the housing adjacent to the base plate, the intermediate support plate having a central aperture therethrough and a pair of recesses formed on opposite ends thereof, wherein the intermediate support member is adapted to be moved within an upper portion of the housing; a bracket formed in the shape of an inverted U with parallel legs extending through the slots and with a horizontal upper surface and an essentially U-shaped receiver for supporting the horizonal bar of free weights; an intermediate base positionable in a horizontal orientation interior of the housing and with a central aperture therethrough and a vertically oriented jack screw extending through the aperture of the intermediate base, the jack screw threadablely engaging the central aperture of the intermediate base; reciprocable pins in a horizontal orientation movable internally into the recesses with a cable secured thereto and extended from the device for effecting the withdrawal of the pins; a large coil spring between the intermediate base and the intermediate support plate to urge the intermediate support plate upwardly upon the pulling of the cables and the release of the intermediate support plate to raise a weight above the support; a small coil spring above the intermediate support plate and beneath the roof of the housing to dampen the force of the large spring; and a pedal positionable in a plurality of positions to receive the free end of the cable to effect the withdrawal of the cable and pin from the recesses of the intermediate support plate, the raising of the bracket and support upon the depression of the pedal, and the pulling of the cable and the withdrawal of the pin from the intermediate support plate.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved system for raising weights when activated by a user in response to a dangerous situation which has all the advantages of the prior art devices of a wide variety of designs and configurations for abating injury while lifting weights and none of the disadvantages.

It is another object of the present invention to provide a new and improved system for raising weights when activated by a user in response to a dangerous situation which may be easily and efficiently manufactured and marketed.

It is further object of the present invention to provide a new and improved system for raising weights when activated by a user in response to a dangerous situation which is of durable and reliable construction.

An even further object of the present invention is to provide a new and improved system for raising weights when activated by a user in response to a dangerous situation which is susceptible of a low cost of manufacture with regard to both materials and labor, and which accordingly is then susceptible of low prices of sale to the consuming public, thereby making such system for raising weights when activated by a user in response to a dangerous situation economically available to the buying public.

Still yet another object of the present invention is to provide a new and improved system for raising weights when activated by a user in response to a dangerous situation which provides in the apparatuses and methods of the prior art some of the advantages thereof, while simultaneously overcoming some of the disadvantages normally associated therewith.

Still another object of the present invention is to lift weights from a user when the user generates a signal at any one of a plurality of locations.

Lastly, it is an object of the present invention to provide a new and improved system for raising weights when activated by a user in response to a dangerous situation comprising a housing; a bracket with at least one essentially U-shaped receiver for supporting a horizonal bar of free weights; a spring mechanism situated within the housing for forcing the U-shaped receiver to an upper extended orientation in an unbiased orientation and allowing the receiver to reside in a lower retracted orientation in a biased orientation; containment mechanism situated within the housing for selectively maintaining the spring mechanism in a biased orientation in a first mode of operation and further allow the spring mechanism to force the U-shaped receiver to an upper extended orientation in a second mode of operation; and releasing mechanism coupled to the containment mechanism for selectively converting the containment mechanism from a first mode of operation to a second mode of operation upon the actuation thereof thus allowing the at least one receiver to uphold the bar with weights situated thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
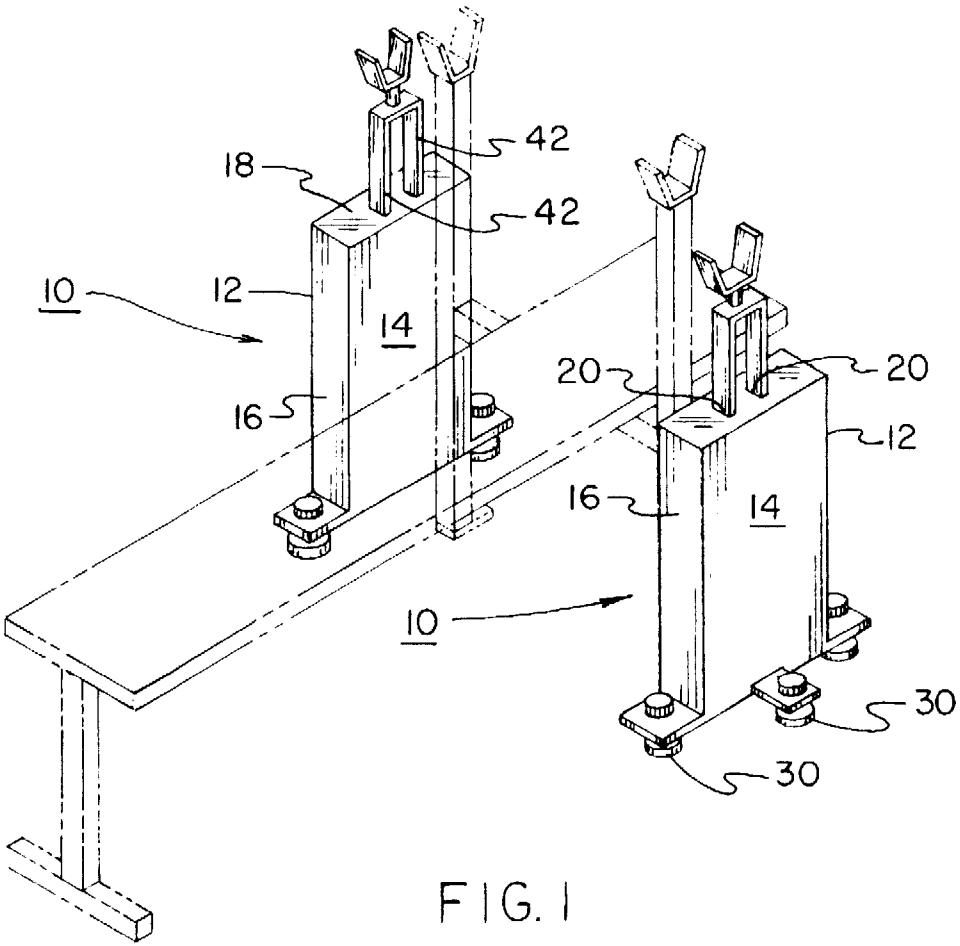
FIG. 1 is a perspective view of the preferred embodiment of the new and improved system for raising weights when activated by a user in response to a dangerous situation constructed in accordance with the principles of the present invention.
Figure 2:
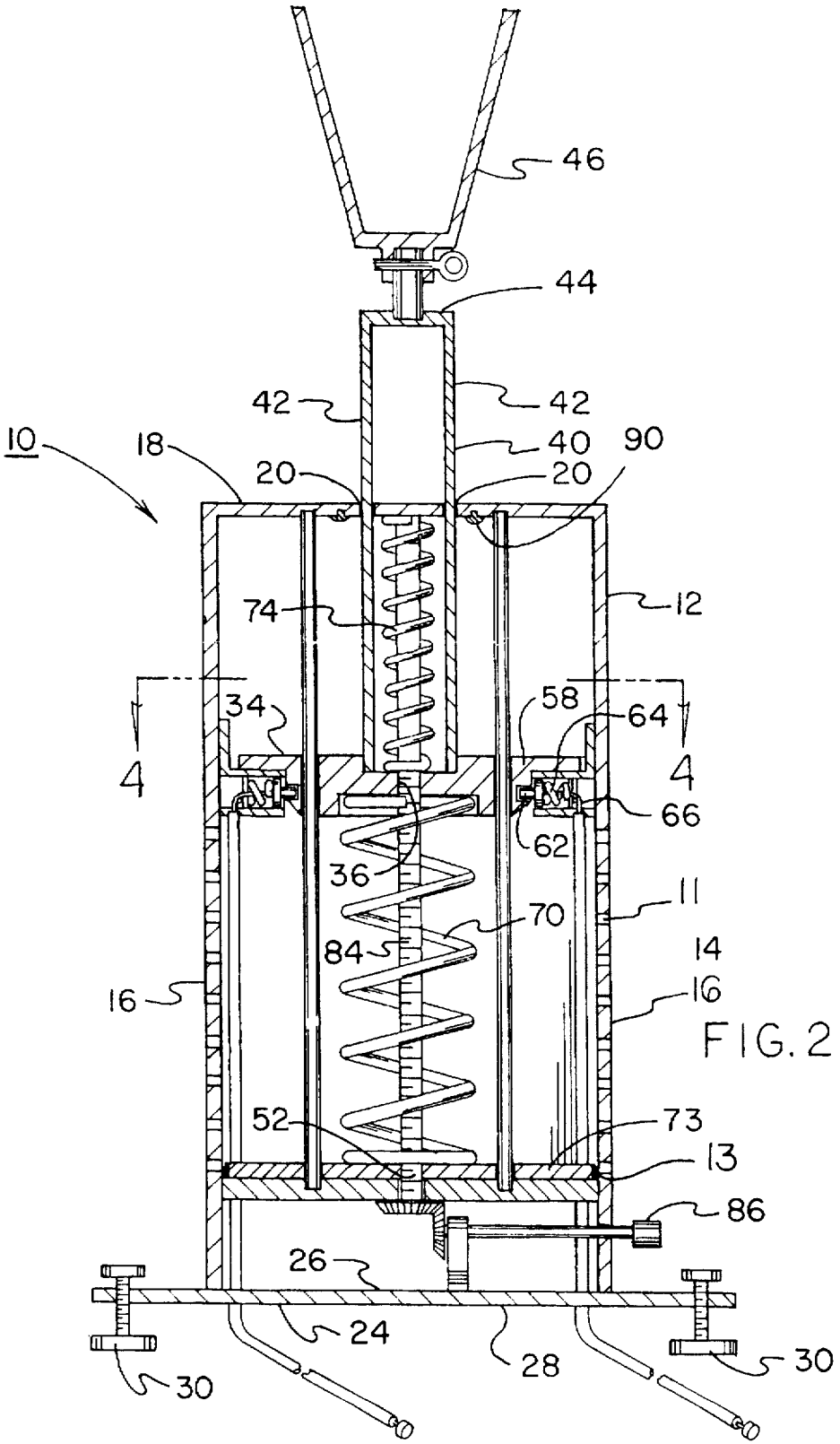
FIG. 2 is a cross-sectional view taken centrally through one of the assemblies shown in FIG. 1.
Figure 3:
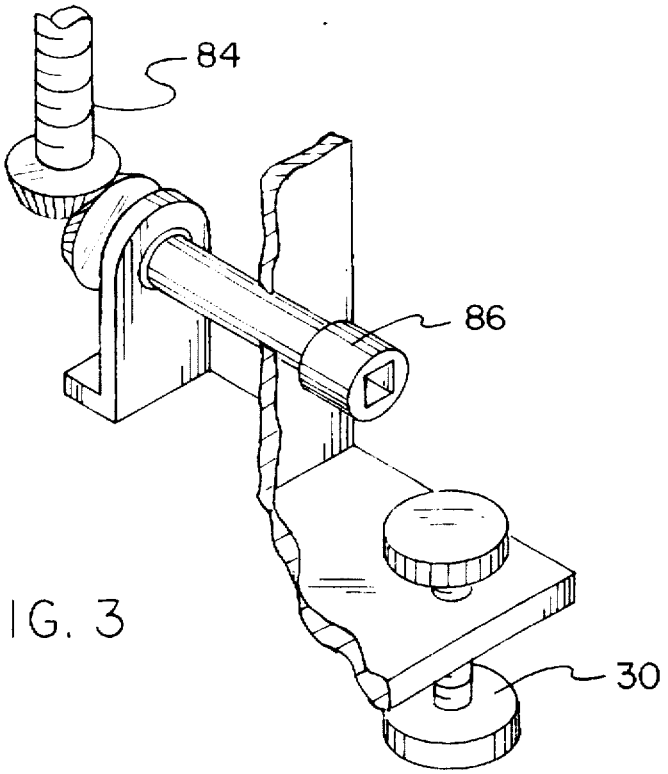
FIG. 3 is an enlarged view of one of the control mechanisms employed in the apparatus of the prior Figure.
Figure 4:
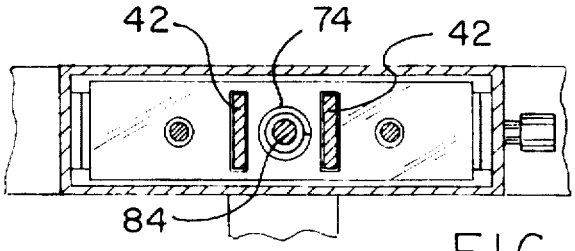
FIG. 4 is a cross-sectional view taken along line 4—4 of FIG. 2.
Figure 5:
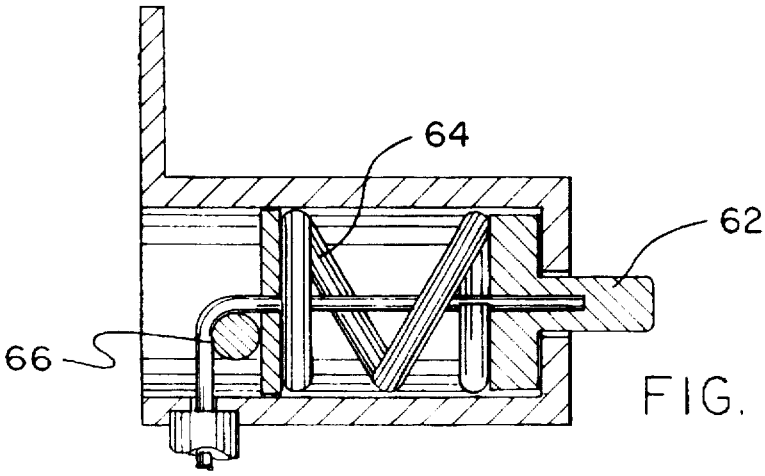
FIG. 5 is a cross-sectional view taken centrally through one of the cable end assemblies of FIG. 2.
Figure 6:
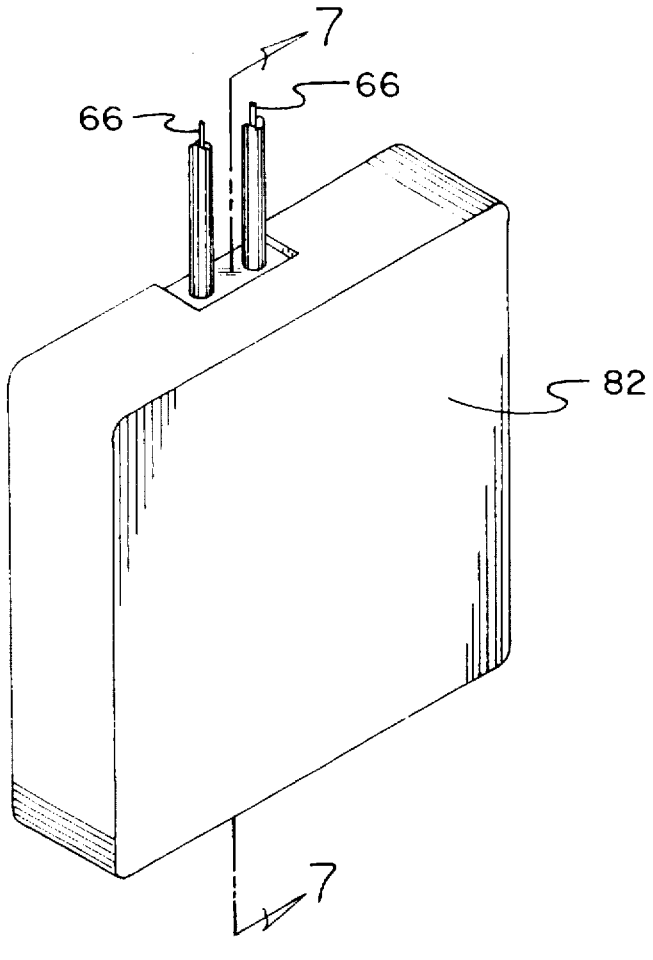
FIG. 6 is a perspective view of one of the actuating mechanisms adapted for use in association with the system of the prior Figure.
Figure 7:
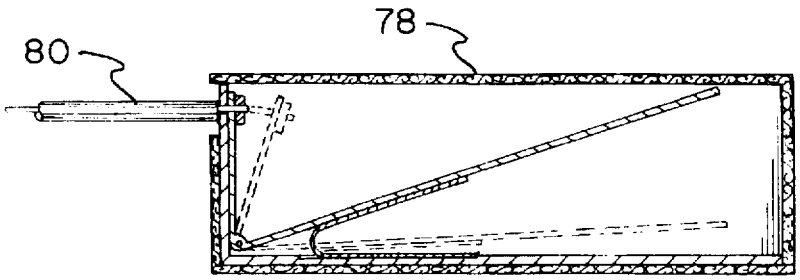
FIG. 7 is a cross-sectional view taken along line 7—7 of FIG. 6.

With reference now to the drawings, and in particular to FIG. 1 thereof, the preferred embodiment of the new and improved system for raising weights when activated by a user in response to a dangerous situation embodying the principles and concepts of the present invention and generally designated by the reference numeral 10 will be described.

The present invention, the new and improved system for raising weights when activated by a user in response to a dangerous situation, is a system 10 comprised of a plurality of components. Such components, in their broadest context, include a housing, a bracket, an intermediate base, reciprocable pins, a large coil spring, a small coil spring and a pedal. Such components are individually configured and correlated with respect to each other so as to attain the desired objective.

The central component of the system 10 is a housing 12. The housing is in a generally rectangular configuration. It has parallel interior and exterior walls 14 and parallel rectangular end wall 16. The walls are coupled at their vertical edges to form a box-like configuration. Such configuration has a planar roof 18 secured to the upper edges of the walls. The roof has two parallel slots 20 extending therethrough.

The housing 12 also has a base plate 24. The base plate has an upper surface 26 and a lower surface 28. The upper surface is for receiving the lower edges of the wall. It has adjustable legs 30 extending from the two sides and front of the base plate 24 in a downward direction. This is for leveling purposes. A plurality of slits 11 are formed in opposite sides of the housing at a lower extent thereof. An intermediate support plate 34 is located within the housing. The intermediate support plate has a pair of horizontally orientated recesses 58 formed on opposite ends thereof. The intermediate support plate also has a central aperture 36 extending therethrough. By means of a pair of members protruding from the sides of the housing, the intermediate support member is adapted to be moved solely within an upper portion of the housing.

Next provided in the system 10 is a bracket 40. The bracket is formed in the shape of an inverted U with parallel legs 42 extending through the slots. Also coupled thereto is a horizontal upper surface 44 and an essentially U-shaped receiver 46. Such U-shaped receiver is for supporting the horizontal bar of free weights. Ideally, such receiver is coated with a elastomeric film. As an option, an elongated rod may be included for releasable coupling between the receiver and the bracket for allowing the receiver to reside in an elevated position thus allowing the device to be utilized while a user performs squats. A specially adapted receiver may also be utilized in conjunction with the rod. Such receiver is wider so that the weight bar need not be positioned directly above the receiver is use.

An intermediate base 73 is positionable in a horizontal orientation interior of the housing. It has a central aperture 52 therethrough. It also has a vertically oriented jack screw 84. The jack screw extends through the aperture of the intermediate base 73 and further is screwably engaged therewith. The intermediate base also has spring-biased retractable ball bearings 13 positioned on opposite side edges thereof. Such ball bearings are adapted to engage the slits of the sides of the housings for reasons that will be later described.

Horizontally reciprocable pins 62 are provided in a horizontal orientation and are movable axially between an internal position and an external position. In such internal position, they are located within the recesses 58 of the intermediate support plate. A cable 66 is secured to the exterior ends of the pins of the system for effecting the withdrawal of the pins from the recesses. Withdrawal of the pins from the pin receiving apertures 58 of the intermediate support plate allows the intermediate support plate to be pushed upward.

A large coil spring 70 is located between the intermediate base 73 and the intermediate support plate. Such large coil spring is included to urge the intermediate support plate upwardly upon the pulling of the cables and the release of the intermediate support plate. This functions to raise the weight above the support to move it away from a lifter of the weights.

Next provided is a small coil spring 74. Such small coil spring is located above the intermediate support plate and beneath the roof of the housing. Such small coil spring functions to counteract the force of the large spring. The small coil provides a dampening effect that prevents the force of the larger coil 70 from throwing the weight from the receiver.

Lastly provided is a pedal 78 with pneumatic lines 80 coupled through an actuator 82. The pedal is positionable in a plurality of orientations. It functions to receive the free end of the cable. In this manner, it may effect the withdrawal of the cable and pin from the recesses of the intermediate support plate. Such action is to allow for the raising of the bracket in support of the depression of the pedal switch. Such action pulls the cable and withdraws the pin from the intermediate support plate. A supplemental rod 86 is rotatable about a horizontal axis to raise or lower the intermediate base 73 through a gear assembly. The intermediate base is raised and lowered when the rod rotatably engages the jack screw. Raising or lowering the intermediate base increases or decreases the tension of the larger coil spring. The amount of tension on the larger coil spring determines the amount of weight capable of being supported by the receiver upon the release of the intermediate support plate. Ideally, a user lowers the intermediate base plate upon the releasing of the reciprocal pins thereby allowing the intermediate support to be lowered with less effort. After the pins are inserted within the recesses and ready for use, the intermediate base may then again be raised. The spring biased ball bearings of the intermediate base prevent the movement thereof due to force exerted by the large coil spring. Such ball bearings also indicate which groove the intermediate base is presently engaged.

The present invention is a device that eliminates the need for a second person to act as a spotter for weight lifters. It should be noted that the above referenced actuator may be situated on a floor near a user for allowing the actuation thereof upon the placing of a foot thereon, on the posterior side of a knee joint of a user with straps for allowing the actuation thereof upon the squatting of the user, and further on the chest of the user for actuation upon the placement of weights thereon. A rubber stopper 90 is provided to absorb the impact of the intermediate support plate hitting the planar roof 18.

If a user develops trouble while lifting weights, he or she can activate this device by stepping on the footpad, laying the weights on the chest, or bending a knee more than 45 degrees. All of these actions will activate the controller. The main spring 70 is released to lift and hold the weight off the user's body. Two units are needed for proper support. This device could be helpful in preventing accidents and could prevent injury to the knees. Because of its three different actuation mechanisms, it can be used in a variety of workouts.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United Sstates is as follows:

1. A new and improved system for raising weights when activated by a user in response to a dangerous situation comprising, in combination:

a housing in a generally rectangular configuration having parallel interior and exterior walls and parallel rectangular end walls, the walls coupled at their vertical edges to form a box-like configuration with a planar roof secured to the upper edges of the walls, the roof having two parallel slots therethrough, the housing also having a base plate with an upper surface and a lower surface, the upper surface receiving the lower edges of the walls with adjustable legs extending from the two sides and front of the base plate in a downward direction for leveling purposes, an intermediate support plate located within the housing, the intermediate support plate having a central aperture therethrough and a pair of recesses formed on opposite ends thereof, wherein the intermediate support member is adapted to be moved within an upper portion of the housing;

a bracket formed in the shape of an inverted U with parallel legs extending through the slots and with a horizontal upper surface and an essentially U-shaped receiver for supporting the horizonal bar of free weights;

an intermediate base positioned in a horizontal orientation interior of the housing and with a central aperture therethrough and a vertically oriented jack screw extending through the aperture of the intermediate base, the jack screw threadedly engaging the central aperture of the intermediate base;

reciprocable pins in a horizontal orientation movable internally into the recesses with a cable secured thereto and extended from the device for effecting the withdrawal of the pins;

a large coil spring between the intermediate base and the intermediate support plate to urge the intermediate support plate upwardly upon the pulling of the cables and the release of the intermediate support plate to raise a weight;

a small coil spring above the intermediate support plate and beneath the roof of the housing to dampen the force of the large spring; and a pedal adapted to be positioned in a plurality of positions to receive the free end of the cable to effect the withdrawal of the cable and pin from the recesses of the intermediate support plate, the raising of the bracket and support upon the depression of the pedal, and the pulling of the cable and the withdrawal of the pin from the intermediate support plate.

2. A system for raising weights when activated by a user in response to a dangerous situation, comprising in combination:

a support frame having a base for positioning on a support surface;

an intermediate base;

an intermediate support located above the intermediate base;

a bracket having a lower end supported on the intermediate base and an upper end, the upper end including a receiver for supporting the bar of a barbell;

means for guiding the bracket for vertical movement with respect to the frame;

means for guiding the intermediate support for vertical movement with respect to the frame;

a large spring located between the intermediate base and intermediate support for urging the intermediate support upward;

a small spring located between the intermediate support and a top portion of the frame for damping the force of the large spring;

means for locking the intermediate support in a locked position proximate the intermediate base wherein the large spring is biased;

means for releasing the locking means upon actuation by the user in response to a dangerous situation whereby the large spring urges the intermediate support, bracket and receiver upward to a safety position; and means for adjusting the static vertical position of the intermediate base with respect to the locked position of the intermediate support whereby the bias of the spring with the intermediate support in the locked position may be adjusted.

3. The system as set forth in claim 2 wherein the releasing means comprises a compressible mechanism adapted to be positioned on a chest of a user laying on a bench for allowing the actuation thereof upon the placing of the bar of a barbell thereon.

4. The system as set forth in claim 2 wherein the releasing means comprises a compressible mechanism adapted to be positioned on a floor near a user for allowing the actuation thereof upon the placing of a foot thereon.

5. The system as set forth in claim 2 wherein the releasing means comprises a compressible mechanism adapted to be positioned on a posterior side of a knee joint of a user for allowing the actuation thereof upon the squatting of the user.

* * * * *